US005142731A

United States Patent [19]

Resch

[11] Patent Number: 5,142,731

[45] Date of Patent: Sep. 1, 1992

[54] DOMESTIC ELECTRICAL VACUUM CLEANER WITH SUCTION TUBE HOLDER

[75] Inventor: Gerald Resch, Rodgau, Fed. Rep. of Germany

[73] Assignee: Rowenta-Werke GmbH, Offenbach am Main, Fed. Rep. of Germany

[21] Appl. No.: 565,350

[22] Filed: Aug. 10, 1990

[30] Foreign Application Priority Data

Aug. 12, 1989 [DE] Fed. Rep. of Germany ..... 3926743

[51] Int. Cl.[5] ..... A47L 9/00

[52] U.S. Cl. ..... 15/339; 15/323

[58] Field of Search ..... 15/323, 339

[56] References Cited

U.S. PATENT DOCUMENTS 4,697,299 10/1987 Brinkhoff et al. ..... 15/323
4,835,814 6/1989 Bonnet ..... 15/339

FOREIGN PATENT DOCUMENTS 895125 3/1944 France ..... 15/323
2128075 4/1984 United Kingdom ..... 15/323

*Primary Examiner*—Chris K. Moore
*Attorney, Agent, or Firm*—Anderson, Kill, Oshinsky

[57] ABSTRACT

The invention relates to a vacuum cleaner with a suction tube nozzle unit, consisting of suction hose, handle, suction tube and suction nozzle, the suction nozzle unit being releasably connected to the vacuum cleaner housing by a coupling device.

9 Claims, 3 Drawing Sheets

DOMESTIC ELECTRICAL VACUUM CLEANER WITH SUCTION TUBE HOLDER

BACKGROUND OF THE INVENTION

The invention relates to a domestic electrical vacuum cleaner consisting of an appliance housing, a suction hose releasably secured thereto with a suction tube fitted thereon and a suction nozzle, the suction tube and/or suction nozzle being connectable to the appliance housing by means of a coupling device.

Vacuum cleaners of the type described above are known. By means of a retaining device, e.g. a pouch formed on the appliance housing into which a hook secured to the suction tube or suction nozzle can engage, these tools, which are absolutely essential for a domestic vacuum cleaner, can be attached to the appliance housing during periods of non-use. As a result of the tidy condition of the entire vacuum cleaner unit which can be achieved in this way at times of idleness of the appliance and the possibility of transportation from one room to another or from one floor to another, the risk of an accident caused by the vacuum cleaner is substantially reduced and the storage space at times of non-use of the domestic electrical appliance is reduced to a minimum without the need to take the vacuum cleaner apart. A vacuum cleaner equipped with a retaining device of this kind remains fully operational at all times.

The vacuum cleaner which comes closest to that of the invention is one which has a releasably attached accessory part. In this known vacuum cleaner, a suction nozzle and an extension tube are fixed to one wall of the vacuum cleaner housing. In order to enable the above-mentioned accessory parts to be fixed using means which are easy to produce and handle, an elongate guide rail which is at least substantially T-shaped in cross section is secured by its central web to the accessory part. In the appliance housing is a mating guide groove having a suitably mating profile and open on its front side at one end. The guide rail can be inserted in the mating guide groove and operatively attached in this way (DE-OS 35 29 133).

A particular disadvantage which has been found with this known vacuum cleaner with its attached accessory part is the fact that the accessory part can only be uncoupled in one direction. Any deviation from the direction of uncoupling is ruled out. If the proper direction of coupling is not observed, the T-shaped central bar tilts out of position in its mating guide groove. As a result, either the accessory part cannot be uncoupled and the entire vacuum cleaner housing together with the accessory part attached thereto will be lifted. However, there is also the possibility that if force is applied in a direction other than the direction of uncoupling, particularly as a result of the intensification of force through the lever arm of the suction tube, the forces acting on the coupling region will exceed the breaking strain of the T-shaped guide rail or the housing in the region of the mating guide groove. In this event, material fractures will occur either in the T-shaped guide rail or in the guide groove located in the housing of the appliance.

SUMMARY OF THE INVENTION

Starting from this prior art, the object of the present invention is to construct a coupling for a suction tube and/or suction tube nozzle to the housing of a domestic electrical vacuum cleaner in such a way that the suction tube and/or suction nozzle fixed to the appliance housing can be uncoupled under normal domestic conditions of roughness without giving rise to the damage described above.

Pursuant to this object, and others which will become apparent hereafter, one aspect of the present invention resides in a coupling device for connecting the suction tube to the vacuum cleaner housing, which coupling device has two parallel or substantially parallel L-shaped sections, the legs of which are of unequal length. The webs of the L-shaped sections are fixed by their surfaces which are remote from the flanges of the coupling device. Two L-shaped retaining members with legs of unequal length and with opposing flanges are formed on the appliance housing at a spacing from one another, the spacing between the flanges being equal to or greater than the spacing of the webs of the coupling device. The flanges engage behind the flanges of the coupling device in the coupling position.

This means that the user of a domestic electrical vacuum cleaner according to the invention will not have to take particular account of the direction of uncoupling when releasing the connection between the vacuum cleaner housing and the suction tube or suction nozzle. Breakages no longer occur in the coupling region. The elasticity of the material used for the coupling region produces a temporary deformation of the L-shaped sections, without exceeding the breaking strain of the coupling material or causing permanent damage to the coupling components. Nevertheless, the suction tube and/or the suction nozzle are securely held in place during times of operation or idleness of the domestic electrical vacuum cleaner. Destruction of the material in the coupling region in the event of unintentional contact with the suction tube and/or suction nozzle coupled to the housing is also ruled out.

According to a further embodiment of the invention, the width of the flanges of the coupling device is less than the height of the webs thereof, while the contact surfaces of the flanges and/or retaining members of the retaining pouch formed on the appliance housing have slide-in slopes. This prevents the flanges and retaining members from becoming caught in the event of lateral application of force. The flanges and retaining members slide past one another and result in elastic deformation of the webs without causing breakage of the material. The slide-in slopes may be of various configurations. It is possible to have chamfer flanges and retaining members or to give them a semi-elliptical, semi-circular or similar cross-section, the outer contour of which follows a curved path.

According to the invention, at least one compression spring is mounted between the webs. This may be a simple helical spring braced between the webs of the coupling device. However, the compression spring may also, according to the invention, be a spring bar connected to the webs, the spring bar and webs of the coupling device enclosing angles which are not equal to a right angle of 90°. A particular advantage of this arrangement is that, when the accessory parts secured by the appliance housing are uncoupled, irrespective of the direction of uncoupling, the springing back into shape of the elastically deformed coupling webs is aided. Forcible breakage of a coupling device equipped as proposed is reliably prevented, particularly as the retaining members and flanges may be made of a material having a substantially higher elasticity, without reducing or in any way endangering the durability of the retaining device. It is also possible to provide a plurality of compression springs or spring bars between the webs of the coupling device and to arrange them in the particularly stressed end regions of the L-shaped sections.

According to another embodiment of the invention, the profile sections of the coupling device form part of a like tube section which is connectable to the suction tube by screwing, shrink-fitting or similar known methods. It is possible for the collar-like tube section and the profile sections including the spring bar or bars to be produced in one operation in a single tool from thermoplastic plastics material using injection molding machines and subsequently to attach them to the suction tube by static friction, for example. This not only simplifies the manufacture of the coupling device according to the invention but also enables it to be replaced by an amateur if the coupling device should need replacement as a result of improper handling.

It is proposed according to the invention that retaining members be formed on various outer surfaces of the appliance housing. Thus, it is conceivable, for example, to provide retaining members on a working surface which is vertical in the operational position of a domestic vacuum cleaner and on the base surface. It is particularly advantageous that the suction tube and suction nozzle should be capable of being attached to the appliance housing at times when vacuum cleaning is not in progress. In addition, a contact-breaker point may be mounted in the region of the retaining cheeks, to cut off the supply of current to the electrical vacuum cleaner when the coupling device is being coupled and switch the current on again when uncoupling is carried out. This also reduces the consumption of current by the domestic vacuum cleaner. However, the particular advantage is the reduced risk of accidents caused by any vacuum cleaner accessories lying untidily around in the working area of the vacuum cleaner during any periods of non-use, such as the vacuum cleaner tube, nozzle and suction hose, while at the same time ruling out injury caused by voltage applied to the vacuum cleaner.

According to a further embodiment of the invention the sections of the coupling device are inclined in a V-shape relative to one another and an arcuate spring bar is clamped between the webs. This procedure substantially simplifies both the coupling and the uncoupling of the coupling device.

According to the invention, each longitudinal center line of the sections is bent in the center of the section and these sections meet so as to form an obtuse angle. However, the longitudinal center lines of the sections may also follow the arc of a circle, the radius of which is substantially greater than the length of the sections. These features make coupling and uncoupling of the uncoupling device substantially easier and increase the strength of the coupling device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF PREFERRED EMBODIMENTS

Figure 1:
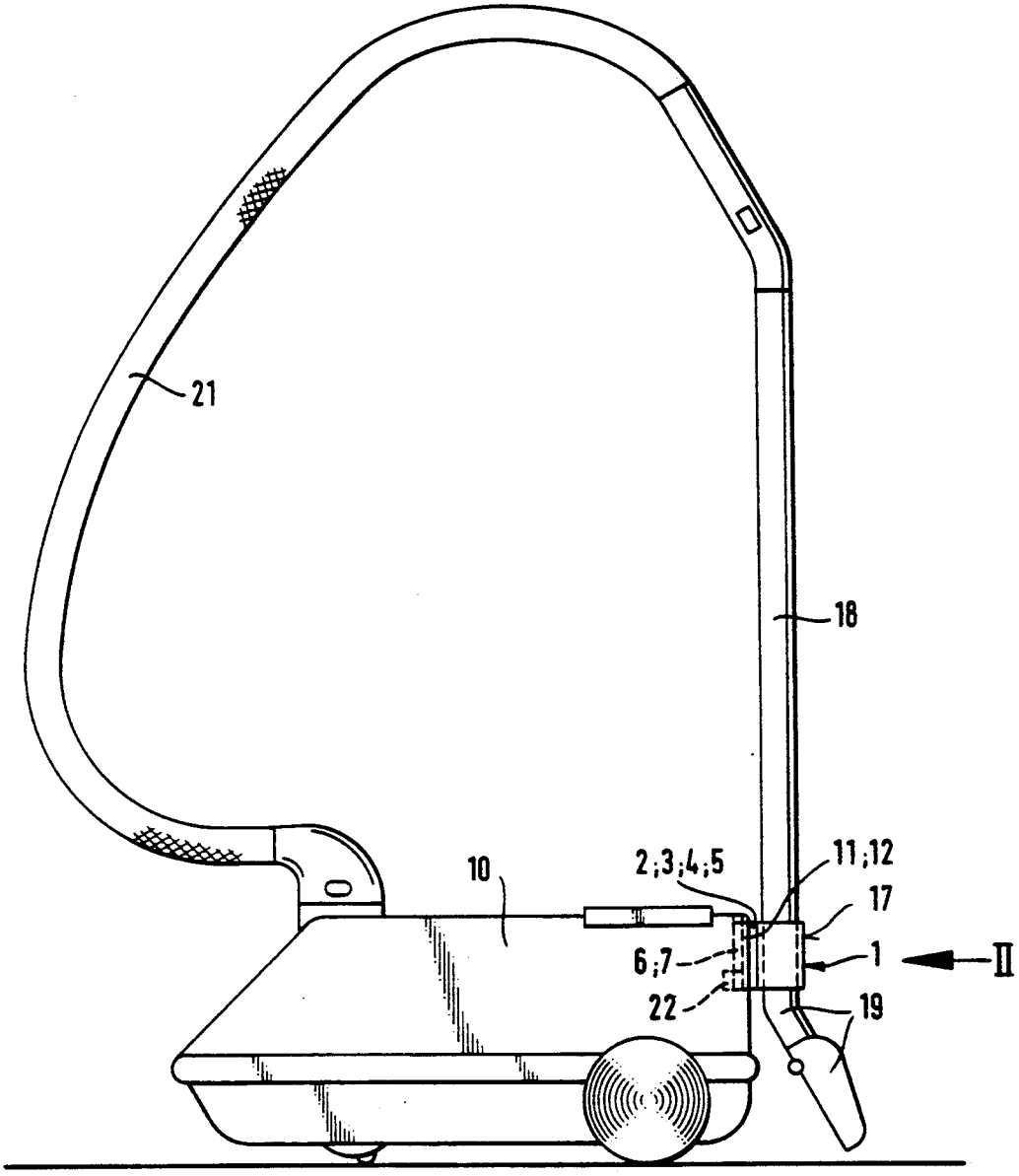
FIG. 1 shows an electrically operated domestic vacuum cleaner with a retaining member and a coupling device with the suction tube coupled thereto.
Figure 4:
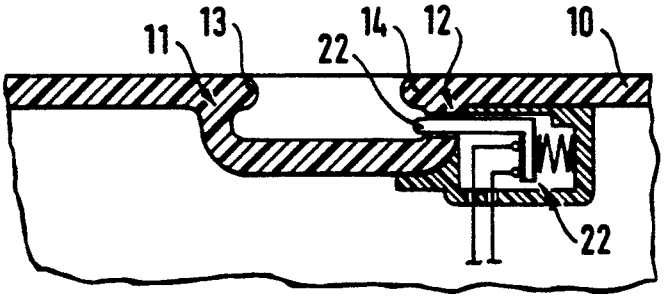
FIG. 4 is a section through the wall of an appliance housing in the region of the retaining members formed in the housing.

As shown in FIG. 4, L-shaped retaining members 11, 12 are formed in the appliance housing 10 of an electrically operated domestic vacuum cleaner. The flanges 13, 14 of the retaining members 11, 12 are rounded, thereby forming contact surfaces. A contact breaker point 22 is fixed in the region of a retaining member 11 or 12 in the appliance housing 10, as shown in FIG. 1. The suction hose 21 is connected at one end to the appliance housing 10 and at the other end to the suction tube 18 on which a suction nozzle 19 in the form of a carpet brush is in turn mounted.

Figure 2:
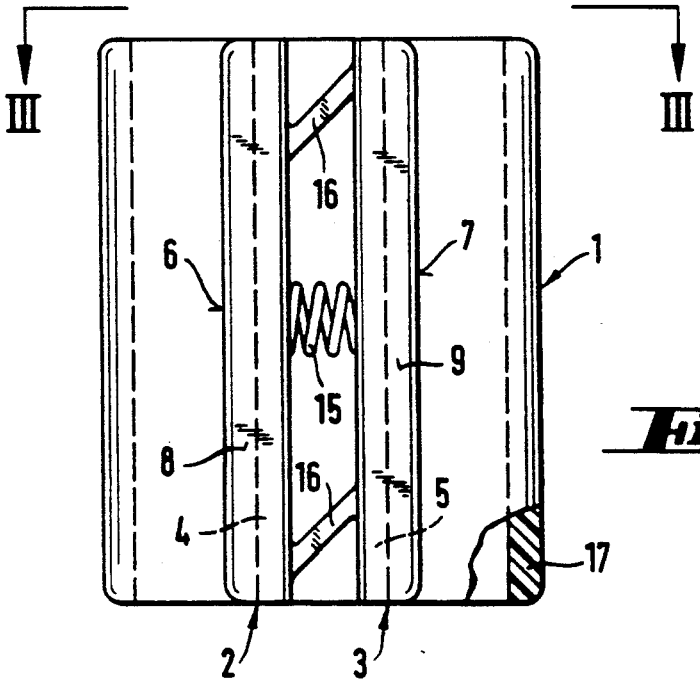
FIG. 2 shows the coupling device according to the invention in front elevation.
Figure 3:
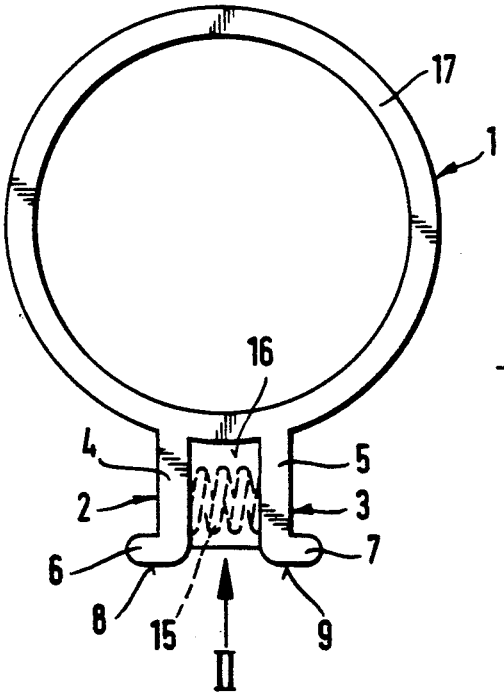
FIG. 3 is a plan view of the coupling device shown in FIG. 2.
Figure 5:
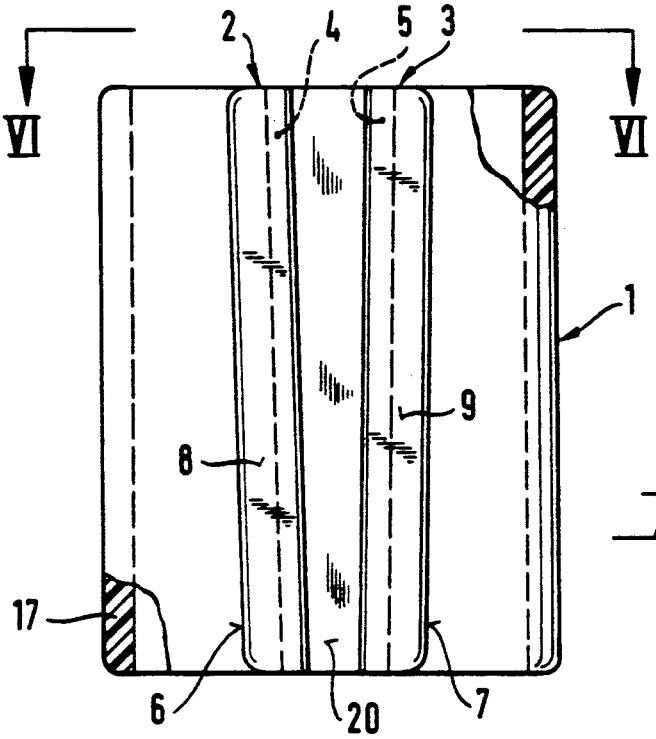
FIG. 5 is another embodiment of the coupling device according to the invention in front elevation.
Figure 6:
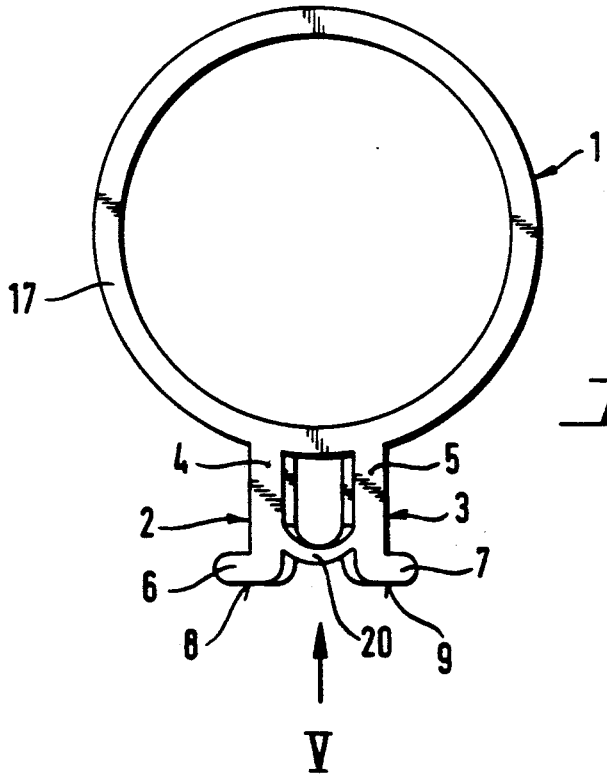
FIG. 6 is a plan view of the coupling device of FIG. 5.

A coupling device 1 is connected to the suction tube 18. This coupling device 1 is clamped by a tube section 17 to the suction tube 18. The webs 4, 5 of two L-shaped sections 2, 3 are connected to one another by means of their surfaces remote from the flanges 6, 7 via the tube section 17, as shown in FIGS. 2 and 3. The webs 4, 5 of the L-shaped sections 2, 3 may also, however, be inclined in a V-shape relative to each other as shown in FIGS. 5 and 6. The flange surfaces 8, 9 of the flanges 6, 7 of the L-shaped sections 2, 3 are rounded, like the flanges 13, 14 of the retaining members 11, 12 and consequently also form contact surfaces. Between the webs 4,5 are secured a compression spring 15 in the form of a helical spring and spring bars 16. As shown in FIG. 6, for example, an arcuate spring bar 20 or a leaf spring may also be clamped in position between the webs 4, 5. The longitudinal axes of the two L-shaped sections 2, 3 run only approximately parallel and enclose an acute angle at their point of intersection (not shown) (FIG. 5). However, it is also possible for the two L-shaped sections 2, 3 to be arranged parallel to each other (FIG. 2). The two spring bars 16 are fixedly connected to the webs 4, 5. The angles enclosed by the axes of the spring bars 16 and the webs 4, 5 are not equal to 90°.

During the coupling of the coupling device 1, the flanges 6, 7 of the L-shaped sections 2, 3 engage behind the retaining members 11, 12 formed on the appliance housing 1. The contact breaker point 22 is actuated by the coupling device 1 and the electrically operated domestic vacuum cleaner is disconnected from the current. However, it is also perfectly possible to construct the contact breaker point 22 as a microswitch, contact switch, Reed contact, or the like. The only important point is that the contact breaker point 22 should be capable of acting as a heavy-duty switch to break the circuit. If it is constructed as a non-heavy-duty switch it is nevertheless possible to stop the supply of current to the vacuum cleaner by means of a low voltage auxiliary circuit, which is particularly desirable in domestic vacuum cleaners which are already equipped with electronics systems.

The vacuum cleaner tube 18 is uncoupled from the vacuum cleaner housing 10 by simply pulling the coupling device 1 out of the retaining cheeks formed on the appliance housing 10. When force is applied by pulling out in a direction other than the direction of uncoupling, the two elastically deformable L-shaped sections 2, 3 are subjected to bending stress. The flange surfaces 8 and 9 and cheek flanges 13, 14 formed as contact surfaces slip past one another and thus aid the uncoupling of the vacuum cleaner tube. The compression spring 15 or spring bars 16 clamped between the webs 4, 5 are also stressed and support the springing back of the L-shaped sections 2, 3 after the uncoupling process has ended.

While the invention has been illustrated and described as embodied in a domestic electrical vacuum cleaner with suction tube holder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A domestic electrical vacuum cleaner, comprising:
an appliance housing;
a suction hose releasably secured to the housing;
a suction tube and a suction nozzle arranged on the suction hose; and
coupling means for connecting at least one of the suction tube and the suction nozzle to the appliance housing, the coupling means (1) including two adjacent spaced longitudinal L-shaped sections (2, 3), each L-shaped section having a web (4, 5) and a flange (6, 7) which are of unequal length, the flange (6, 7) being arranged at one end of the webs (4, 5) of the L-shaped sections (2, 3) being spaced and fixedly secured to one of the suction tube or the suction nozzle at ends remote from the flanges (6, 7) of the L-shaped sections, the coupling means further including two L-shaped retaining members (11, 12) with legs of unequal length and with opposing flanges (13, 14) formed on the appliance housing (10) at a spacing from one another, the spacing between the opposing flanges (13, 14) being at least equal to the spacing of the webs (4, 5) of the L-shaped sections (2, 6), the opposing flanges (13, 14) being engageable behind the flanges (6, 7) of the L-shaped sections (2, 3) in a coupling position.

2. A domestic electrical vacuum cleaner according to claim 1, wherein the flanges (6, 7) are shorter than the webs (4, 5), at least one of the flanges (6, 7) and of the members (11, 12) having contact surfaces shaped so as to facilitate sliding contact between the flanges (6, 7) and the members (11, 12).

3. A domestic electrical vacuum cleaner according to claim 1, and further comprising at least one compression spring (15) arranged between the webs (4, 5).

4. A domestic electrical vacuum cleaner according to claim 3, wherein the at least one spring (15) is a spring bar (16) having a length which is greater than the spacing of the webs (4, 5), the spring bar (16) and the webs (4, 5) being fixedly connected to one another so that the webs (4, 5) and the spring bar (16) enclose angles which are not equal to a right angle.

5. A domestic electrical vacuum cleaner according to claim 4, wherein the L-shaped sections (2, 3) are part of a collar-shaped tube section (17) which is connectable to the suction tube (18).

6. A domestic electrical vacuum cleaner according to claim 1, wherein the coupling means (1) is fixedly connected to the suction nozzle (19).

7. A domestic electrical vacuum cleaner according to claim 1, wherein a contact breaker point (22) is provided in the region of the retaining members (11, 12).

8. A domestic electrical vacuum cleaner according to claim 1, wherein the L-shaped sections (2, 3) are longitudinally inclined relative to one another in a V-shape, and an arcuate spring bar (20) is clamped between the webs (4, 5).

9. A domestic electrical vacuum cleaners according to claim 1, wherein the longitudinal L-shaped sections (2, 3) are parallel.

* * * * *